US007886383B1

(12) United States Patent
Plimmer

(10) Patent No.: US 7,886,383 B1
(45) Date of Patent: Feb. 15, 2011

(54) REVERSIBLE CONTOURED INFANT NURSING PAD

(75) Inventor: Wanda Plimmer, 1621 W. 25th St., Suite 142, San Pedro, CA (US) 90732

(73) Assignee: Wanda Plimmer, Palos Verdes Pen., CA (US)

( * ) Notice: Subject to any disclaimer, the term of this patent is extended or adjusted under 35 U.S.C. 154(b) by 1089 days.

(21) Appl. No.: 11/516,969

(22) Filed: Sep. 8, 2006

Related U.S. Application Data

(63) Continuation-in-part of application No. 10/822,831, filed on Apr. 12, 2004, now abandoned.

(51) Int. Cl.
*A47D 13/08* (2006.01)
*A47D 13/02* (2006.01)

(52) U.S. Cl. ..... 5/655

(58) Field of Classification Search ..... 5/655, 5/652, 630, 632, 603; D6/333
See application file for complete search history.

(56) References Cited

U.S. PATENT DOCUMENTS

| | | | | | |
|---|---|---|---|---|---|
| D192,421 | S | * | 3/1962 | Bostrom | D6/356 |
| 3,712,673 | A | * | 1/1973 | Swenson | 297/452.61 |
| 4,131,313 | A | * | 12/1978 | Jacobs | 297/188.2 |
| 4,733,836 | A | * | 3/1988 | Barnes | 248/106 |
| D296,047 | S | * | 6/1988 | Kucera et al. | D6/333 |
| D341,736 | S | * | 11/1993 | McDonald | D6/502 |
| D346,069 | S | * | 4/1994 | Schwenker | D6/333 |
| 5,341,531 | A | * | 8/1994 | Straub et al. | 5/655 |
| 5,347,669 | A | * | 9/1994 | Neviaser et al. | 5/655 |
| 5,387,177 | A | * | 2/1995 | Dunn | 600/22 |
| 5,522,104 | A | * | 6/1996 | Little | 5/632 |
| 5,551,109 | A | * | 9/1996 | Tingley et al. | 5/655 |
| 5,581,832 | A | * | 12/1996 | Bridley | 5/655 |
| 5,790,999 | A | * | 8/1998 | Clark | 5/655 |
| 6,048,023 | A | * | 4/2000 | Lampton | 297/129 |
| 6,370,715 | B1 | * | 4/2002 | Morton | 5/655 |
| 6,473,923 | B1 | * | 11/2002 | Straub | 5/655 |
| 6,564,408 | B2 | * | 5/2003 | Van Vuuren | 5/655 |
| 6,763,539 | B1 | * | 7/2004 | Bartley et al. | 5/655 |
| 2004/0060117 | A1 | * | 4/2004 | Chan | 5/655 |
| 2004/0181878 | A1 | * | 9/2004 | Stelnicki | 5/655 |

* cited by examiner

*Primary Examiner*—Michael Safavi

(57) ABSTRACT

A contoured infant nursing pad includes a base, multiple retaining walls on the perimeter of the base for retaining an infant on the base, and a front safety ridge on the base perimeter for retaining the infant in an optimal nursing position and for preventing a mother from rolling onto the infant. First and second breast planar shelves are located on the base and are each on an opposite side of the front safety ridge and located at an opening in the base perimeter between the front safety ridge and one of the multiple retaining walls. Each breast shelf is tilted downward away from the opening to align the infant's mouth for breastfeeding. An infant placed on the base and facing the breast shelf can access a breast placed on the breast shelf. The infant nursing pad is reversible allowing flexible orientation of the mother and infant.

18 Claims, 3 Drawing Sheets

REVERSIBLE CONTOURED INFANT NURSING PAD

This is a continuation in part application of patent application Ser. No. 10/822,831 filed Apr. 12, 2004, now abandoned which is incorporated herein by reference as though set forth in full.

BACKGROUND OF THE INVENTION

1. Field of the Invention

This invention relates to infant care and more particularly to accessories for breastfeeding infants.

2. Description of the Related Art

There are a number of infant breastfeeding accessories in the prior art that provide some assistance while breastfeeding. U.S. Pat. No. 6,601,252 to Leach is one such device and provides a double pillowcase assembly and an anchor pad extending outwardly from the pillowcase assembly. This arrangement may provide support for a reclining mother, but does little to support the infant. U.S. Pat. No. 6,237,599 to Maulding provides a breastfeeding breast support roll that is placed underneath the breastfeeding breast allowing a woman to breastfeed an infant in an upright position. The support roll does not provide support for an infant. U.S. Pat. No. 6,189,169 to Marcotte describes an adjustable wrap for a pillow that can be used to support a baby when the mother is nursing the baby on top of the pillow on her lap. Straps attached to the adjustable wrap can be secured around a mother's waist. This design provides some support but the mother must hold the baby on the pillow to keep the baby from falling off. Crowley teaches in U.S. Pat. No. 6,061,854 another adjustable pillow assembly that can be attached to the mother for supporting objects on a wearer's lap. Again this design does provide a vertical support for holding the baby on one's lap, but the baby must be held to prevent the baby from falling off. Powell in U.S. Pat. No. 5,950,887 teaches a baby sling which can be used to support a baby during nursing. The sling is most appropriate when the mother is standing or sitting. Clark in U.S. Pat. No. 5,790,999 describes a U-shaped pillow which is wrapped around a sitting mother and can be used to nurse twins, with each twin attached to opposite breasts with their bodies extending along each side of the U-shaped pillow. Here again although the device vertically supports the babies, they must be held on to prevent them from falling off the pillow. U.S. Pat. No. 5,707,031 to Creighton-Young is an entirely different type of device and is designed to fit over the forearm to assist in nursing the baby. One part of the device can hold a nursing bottle. U.S. Pat. No. 5,522,104 to Little describes a lateral recumbency support pillow for supporting the back of someone lying down. This may help during breastfeeding but does not support the baby. U.S. Pat. No. 5,133,098 to Weber describes an inflatable baby support pillow. This is another form of pillow but has some of the same limitations as other pillows, in that the baby must still be held onto the pillow. U.S. Pat. No. 5,029,351 to Weber describes another baby support pillow.

It is often difficult to arrange and maintain an infant in an orientation that is comfortable and safe for the nursing infant and while at the same time positioning the infant in a location that is comfortable for the mother. It is also difficult to position a baby's mouth to a mother's nipple to ensure a proper latch without a new mother holding her breast to her baby's mouth for long durations of time. It is common knowledge that new mothers are deprived of sleep and very fatigued.

It is also understood that the act of breastfeeding produces hormonal releases of oxytocin and prolactin. Both hormones are described in La Leche League Internationals' The Womanly Art Of Breastfeeding, (an authoritative guide) on page 363, "Both prolactin and oxytocin may help to produce the feeling of relaxation that mothers come to associate with nursing sessions."

It would be desirable to have a pad that would be useful whether the mother is sitting or lying down. Falling asleep in the side-lying nursing position is a common occurrence. Therefore it would be desirable, to have an infant nursing pad that could be used to support a nursing infant while the infant is lying on either its left or its right side, or while the mother is lying on either her left or right side. It would also be desirable to have an infant nursing pad that can be used on a desk or table top so that the mother can work at the desk or table while nursing the infant. It would also be desirable to have such a nursing pad that included a removable cover to allow the nursing pad to be maintained in a sanitary condition.

SUMMARY OF THE INVENTION

A contoured infant nursing pad includes a base, multiple retaining walls on the perimeter of the base for retaining an infant on the base, and a front safety ridge on the base perimeter for retaining the infant in an optimal nursing position and for preventing a mother from rolling onto the infant. First and second breast planar shelves are located on the base and are each on an opposite side of the front safety ridge and located at an opening in the base perimeter between the front safety ridge and at least one of the multiple retaining walls. Each breast shelf is tilted downward away from the opening to align the infant's mouth for breastfeeding. An infant placed on the base and facing the breast shelf can access a breast placed on the breast shelf. The infant nursing pad is reversible allowing flexible orientation of the mother and infant.

A recess is located in the base adjacent to each breast shelf for accommodating an infant's shoulder and arm and each recess has a depth lower than the breast shelf.

A cover can be placed over the contoured infant nursing pad for providing comfort and facilitating cleaning. Pockets are placed on the cover for holding items within easy reach of the nursing person using the contoured infant nursing pad.

Other objects and many of the attendant features of this invention will be more readily appreciated as the same becomes better understood by reference to the following detailed descriptions and considered in connection with the accompanying drawings in which like reference symbols designate like parts throughout the figures.

DETAILED DESCRIPTION

Figure 1:
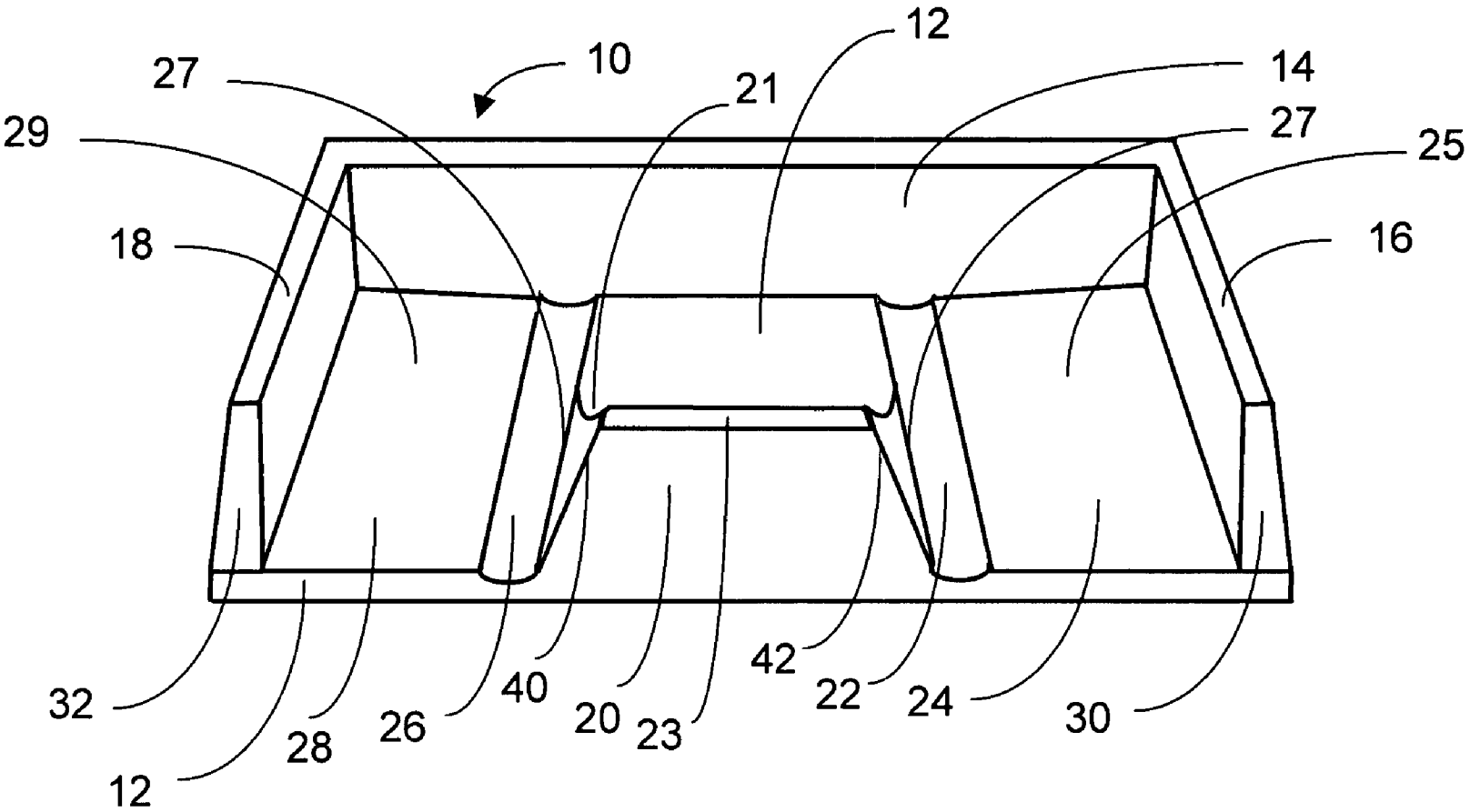
FIG. 1 is a front perspective view of the contoured infant nursing pad in accordance with the present invention.

Referring now to the drawings, FIG. 1 shows a reversible contoured nursing pad 10, which has a molded, resilient, contoured foam body made of a flexible elastic material such as vinyl coated polyurethane foam. The contoured nursing pad 10 is preferably molded as an integral unit or can be assembled from its elements. The base 12 can be many shapes, including oblong and rectangular, which is the shape shown in FIG. 1. On the rear perimeter of the base 12 is back support wall 14, which has as its purpose retaining an infant on the base. Without the back support wall 14 the infant could roll off the rear of the base and potentially fall off a bed or other surface on which the reversible contoured nursing pad 10 is placed. First side wall 16 and second side wall 18 also have the purpose of retaining the infant on the base. As shown in FIG. 1, the first and second side walls 16 and 18 are on opposite peripheries of the base 12 and are connected to the back support wall 14; however, the back support wall, the first side wall and the second side wall can be separate non-connected walls and still perform the same function. These walls can also be made of a flexible elastic material such as vinyl coated polyurethane foam.

A front safety ridge 20 is located at the front periphery of the base 12 opposite the back support retaining wall 14. The front safety ridge 20 retains a nursing infant in an optimal nursing position and prevents the infant from rolling forward off the base. The front safety ridge 20 also provides a barrier to prevent a mother from inadvertently rolling onto the infant. The front safety ridge 20 can also be made of a flexible elastic material such as vinyl coated polyurethane foam.

Together the base 12, back support retaining wall 14, first side wall 16, second side wall 18, and front safety ridge 20 operate to retain an infant within the contoured nursing pad 10. Together they also provide a safe position for an infant, keeping the infant within the contoured nursing pad 10, while also helping to keep others such as sleeping parents out of the contoured nursing pad 10. Often an infant is brought into bed with the parents while the mother is nursing. The design of the contoured nursing pad 10 helps to define the boundaries of where in the bed the infant is located and creates an effective "keep out" zone, which provides comfort and safety for the infant.

When nursing in bed or in a lie-down position, the mother can be either on her left or right side. As shown in FIG. 1, the front safety ridge 20 is centered on the front periphery of the base 12. This symmetry allows the contoured nursing pad 10 to be reversible, which also allows the infant to lie on its left or right side for comfort. Once the infant is aligned in the contoured nursing pad 10, the mother can feed the infant from either breast with a simple shoulder shift—allowing the infant to continue nursing uninterrupted.

The contoured nursing pad 10 can be used in other locations such as on a desk or tabletop. Tabletop breastfeeding can be advantageous, because it allows the mother to nurse the baby while sitting in a chair facing the baby in the contoured nursing pad 10, while it is on top of a table or desk. This method allows the mother freedom to perform other work while breastfeeding, such as writing out bills, working on a computer, or helping other children with homework. This method of nursing also offers relief by removing pressure from the abdomen while surgical wounds heal.

The contoured nursing pad 10 can also be used in a clutch hold, cradled in one arm. A mother can use this position to comfortably hold the infant while breastfeeding. Alternatively, a mother or father can use the contoured nursing pad 10 for bottle-feeding the infant. The contoured nursing pad 10 is cradled in one arm while the hand of the other arm positions a bottle for the infant. A mother or father can also lie down in bed and use their hand to position a bottle for feeding their newborn lying in the contoured nursing pad.

A mother uses the contoured nursing pad 10 for nursing by placing a breast on either of two breast shelves 24 and 28. The first breast shelf 24 is located on the base 12 on one side of the front safety ridge 20 and is accessed by placing a breast on the first breast shelf through an opening between the front safety ridge and a side wall. The second breast shelf 28 is located on the base 12 on the other side of the front safety ridge 20 and is similarly accessed by placing a breast on the second breast shelf through an opening between the front safety ridge and a side wall.

Each of the breast shelves 24 and 28 has a flat planar surface. The planar first breast shelf 24 extends to the back wall 14 and to the first side wall 16. The planar second breast shelf 28 extends to the back wall 14 and to the second side wall 18. Each planar breast shelf 24 and 28 provides a shelf for a breast, and also provides an area for an infant headrest 25 and 29, respectively.

Each breast shelf is on an opposite side of the contoured infant nursing pad 10 and is slightly inclined downward toward the back support wall and the adjacent side wall to align the infant's mouth for breastfeeding. In particular, planar breast shelf 24 and therefore infant headrest 25 are slightly inclined downward toward the back support wall 14 and toward the adjacent first side wall 16. Similarly, planar breast shelf 28 and therefore infant headrest 29 are slightly inclined downward toward the back support wall 14 and toward the adjacent second side wall 18. The breast shelves 24 and 28 are inclined as described above to incline the infant's head placed on the infant headrest area to provide a direct nipple-to-mouth alignment, allowing a mother a free hand to caress her newborn.

Figure 2:
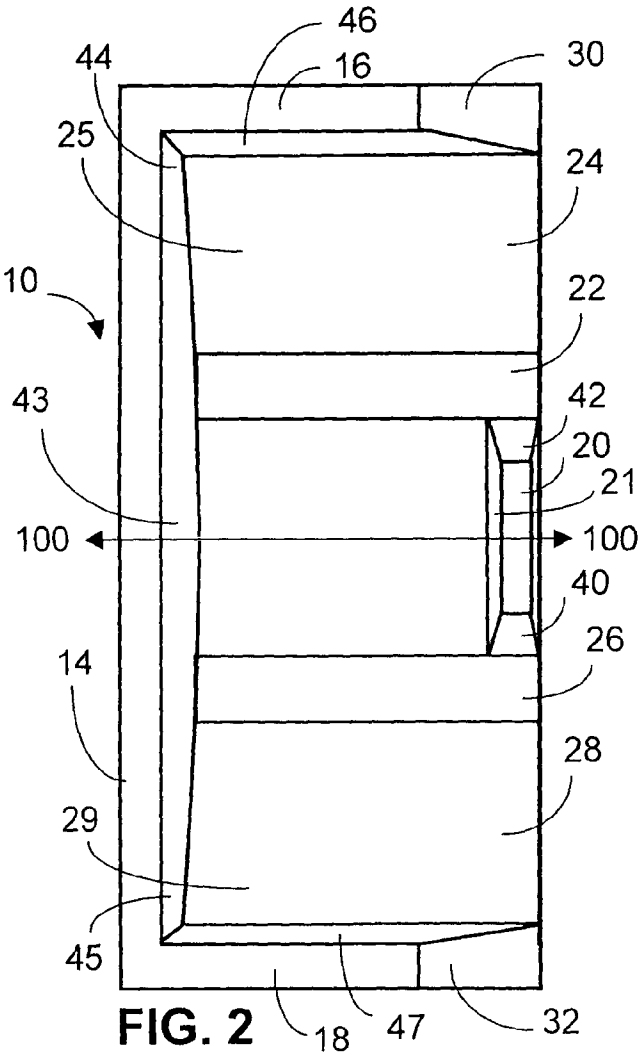
FIG. 2 is a top view of the contoured infant nursing pad of FIG. 1 in accordance with the present invention.

Recesses 22 and 26 in the base are provided to afford more comfort to the infant. The recesses are adapted to accommodate an infant's shoulder and arm. When the infant is lying on its left side, the infant's shoulder and arm would be accommodated by recess 22. When the infant is lying on its right side, the infant's shoulder and arm would be accommodated by recess 26. The recesses 22 and 26 each have a depth that is lower than the adjacent breast shelves 24 and 28, respectively. As shown in FIGS. 1 and 2, each recess 22 and 26 can be a trough that extends from the front periphery to the back support wall 14. Also as shown in FIGS. 1 and 2, each trough 22 and 26 is aligned essentially perpendicular to the front periphery of the base 12 and the back support wall 14. The troughs accommodate an infant's shoulder and arm, helping to keep the infant positioned while breastfeeding and also helping to create the perfect neck and spinal vertebral alignment for the nursing infant allowing maximum comfort. The troughs also allow for a more open airway, enabling easy breathing for the side-lying infant. This is a concern amongst medical professionals that exists with an infant lying on its side on a flat, non-contoured surface. The angle at which each trough 22 and 26 meet the adjacent breast shelves 24 and 28, respectively, provides support for the infant's neck while lying in the contoured nursing pad.

As shown in FIG. 1, both sides 40 and 42 of the front safety ridge 20 are tapered so that the top 23 of the front safety ridge is narrower than at the bottom 27 of the front safety ridge. This transition affords more comfort for the infant and allows the infant to rest an arm on the transition. As shown in FIGS. 1 and 2, the ends 30 and 32 of the first side wall 16 and the second side wall 18, respectively, are also tapered from the top of the side walls to where the side wall meet the base near the front of the contoured nursing pad 10. This taper provides comfort and allows the infant to extend its legs out the opening near the unused breast shelf. The taper also allows a nursing mother to watch over her infant, and as well, have eye contact with her feeding infant while her infant is lying in the contoured nursing pad.

Figure 3:
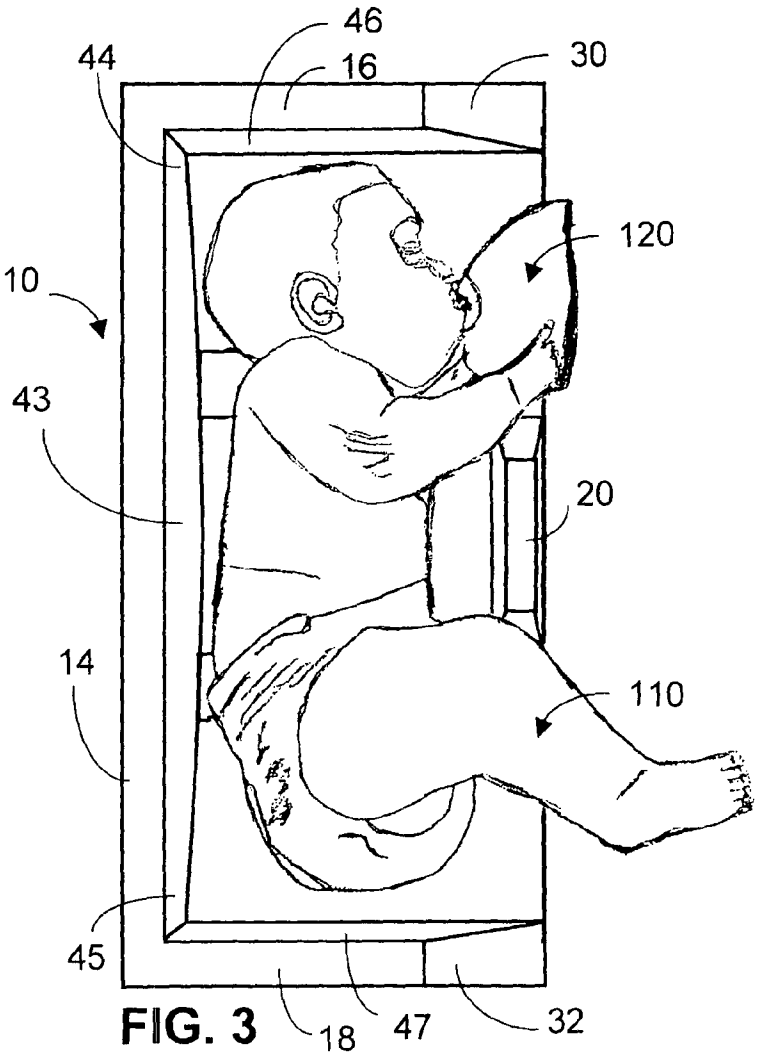
FIG. 3 is a top view of the contoured infant nursing pad of FIG. 1 with an infant retained in the contoured infant nursing pad with its left shoulder and arm comfortably in a recess in the nursing pad and its head positioned for nursing facing the breast shelf in accordance with the present invention.

The front safety ridge 20 has a curved transition 21 from the top 22 of the front safety ridge 20 to the base 12. The curved transition 21 comfortably accommodates the curvature of an infant's belly, which is placed against the curved transition 21 when the infant is nursing, as shown in FIG. 3.

FIG. 2 is a top view of the contoured infant nursing pad of FIG. 1. The contoured infant nursing pad 10 is symmetrical along a center line 100 to form a left nursing portion and a right nursing portion to allow an infant to be arranged on its left side or its right side to feed from either of the mother's breasts as she lies on her left side or her right side.

The back support wall 14, as shown in FIG. 2, is wider at the bottom than at the top. The vertical taper 43 provides the transition from the top of back support 14 to the base 12 and in particular to the infant headrests 25 and 29. As shown in FIG. 2, the back support wall 14 is also tapered so that it becomes narrower as it extends from the center line 100 to near the intersection with the first side wall 16 at location 44, and to near the intersection with the second side wall 18 at location 45. This taper provides more space for the infant's head where the back support wall is narrower. The taper also provides support for the infant's back, because the infant's back when nursing is positioned where the back support wall is thicker near the center line 100. This effectively provides lumbar support for the infant's back.

A vertical taper 46 of the first side wall is also provided, as well as a vertical taper 47 of the second side wall 18, so that the first and second side walls are wider at the base 12 than at their tops. A curved transition 21, as discussed above, is also provided for front safety ridge 20 from the top of the front safety ridge 20 to the base 12, which allows the front safety ridge to better conform to the baby's belly. These tapers and transitions, along with vertical taper 43, provide comfort for the baby and allow for air circulation to the baby's head and body. This is important, because when babies nurse they perspire. Straight vertical walls would inhibit airflow and could cause a baby to be overheated, possibly causing a fever.

FIG. 3 is a top view of the contoured infant nursing pad of FIG. 1 showing an infant 110 retained in the contoured infant nursing pad 10 with its left shoulder and arm comfortably in recess 22 and its head positioned on the headrest 25 for nursing. The infant is facing breast shelf 24 on which breast 120 is resting for the infant to access for nursing.

Figure 4:
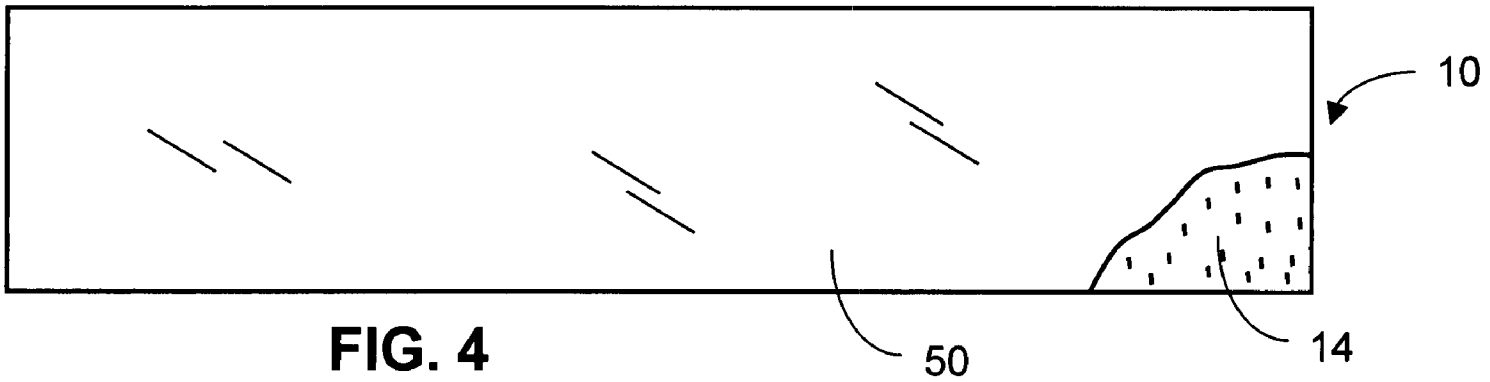
FIG. 4 is a rear elevation view of the contoured infant nursing pad of FIG. 1 showing a cover on the contoured infant nursing pad in accordance with the present invention.

FIG. 4 is a rear elevation view of the contoured infant nursing pad 10 showing a cover 50 on the contoured infant nursing pad 10, which can be made of many materials, including fabric. The cover 50 is removable to allow for laundering as needed. A fabric cover can be used that offers warmth and comfort for the infant. FIG. 4 also shows that the bottom of the contoured infant nursing pad 10 is flat, which facilitates using the contoured infant nursing pad on flat surfaces such as on table tops and on various hospital equipment including open warmers.

Figure 5:
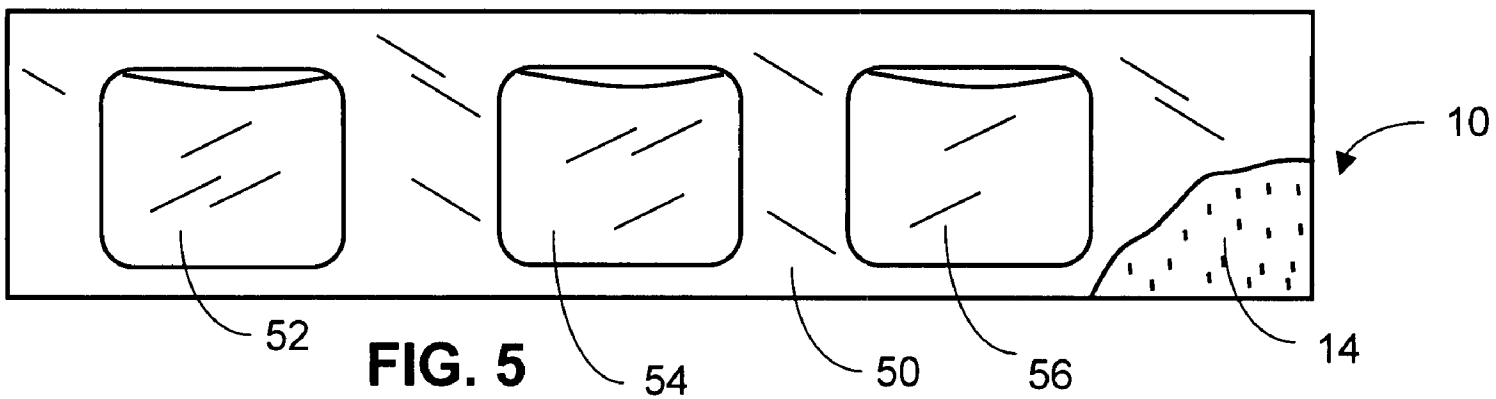
FIG. 5 is a rear elevation view of the contoured infant nursing pad of FIG. 1 showing pockets on the cover over the contoured infant nursing pad in accordance with the present invention.

FIG. 5 shows an instantiation of the cover 50 with pockets 52, 54, and 56 on the cover. The pockets can be used to hold various items such as other baby accessories or even a TV remote control or cell phone for convenient access by the mother while nursing. By locating the pockets on the rear of the back support wall, the items in the pockets are not in the way between the mother and the infant, while at the same time being quite accessible. Pockets can also be located on the sides of the cover.

An accessory that can be added inside of the contoured infant nursing pad 10 is a phototherapy pad. The phototherapy pad is placed on top of the base 12 and the infant is placed on the phototherapy pad, which emits ultra-violet light. Phototherapy is the process of using light treatment to eliminate high amounts of bilirubin in the infant's blood, which causes jaundice. The infant's skin and blood absorb the ultra-violet light waves, which change bilirubin into products that are then passed through the infant's system. The contoured infant nursing pad 10 is ideal for retaining the infant on the phototherapy pad during the light treatment.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope of the present invention and additional fields in which the present invention would be of significant utility.

It is therefore intended by the appended claims to cover any and all such applications, modifications and embodiments within the scope of the present invention.

What is claimed is:

1. A contoured infant nursing pad for use in nursing an infant, the contoured infant nursing pad comprising:

a base having a first periphery, a second periphery, a third periphery, and a fourth periphery;

a back wall coupled to the base adjacent the first periphery for retaining the infant on the base;

a first side wall coupled to the base adjacent the second periphery for retaining the infant on the base;

a second side wall coupled to the base adjacent the third periphery for retaining the infant on the base;

a front safety ridge coupled to the base adjacent the fourth periphery for retaining the infant in an optimal nursing position and for preventing a nursing person from rolling onto the infant, wherein the fourth periphery is opposite the first periphery, the front safety ridge comprising:

a first edge on a first side of the front safety ridge;

a second edge on a second side of the front safety ridge;

a top of the front safety ridge, the top located between the first edge and the second edge; and a curved transition from the top of the front safety ridge to the base toward the back wall;

wherein the infant reclined between the front safety ridge and the back wall is retained by the front safety ridge and the back wall;

a first opening along the fourth periphery between the first edge of the front safety ridge and the first side wall;

a first breast shelf located on the base adjacent the first opening;

wherein the first breast shelf is planar; and wherein the planar first breast shelf extends and is inclined downward toward the back wall for aligning the infant's mouth for breastfeeding;

a second opening along the fourth periphery between the second edge of the front safety ridge and the second side wall; and a second breast shelf located on the base adjacent the second opening;

wherein the second breast shelf is planar; and wherein the planar second breast shelf extends and is inclined downward toward the back wall for aligning the infant's mouth for breastfeeding;

wherein the infant placed on the base between the back wall, first side wall, second side wall and front safety ridge with the infant's head placed on the first breast shelf and facing the first opening can access a breast of the nursing person placed on the first breast shelf through the first opening; and wherein the infant placed on the base between the back wall, first side wall, second side wall and front safety ridge with the infant's head placed on the second breast shelf and facing the second opening can access the breast of the nursing person placed on the second breast shelf through the second opening.

2. The contoured infant nursing pad of claim 1 wherein:

the planar first breast shelf extends and is further inclined downward toward the first side wall for aligning the infant's mouth for breastfeeding; and the planar second breast shelf extends and is further inclined downward toward the second side wall for aligning the infant's mouth for breastfeeding.

3. The contoured infant nursing pad of claim 1 further comprising:

a first recess in the base located between the front safety ridge and the first breast shelf and extending from the fourth periphery to the back wall, the first recess having a depth lower than the planar first breast shelf, and the first recess adapted for accommodating in the first recess a first shoulder and a first upper arm of the infant when the infant's head is placed on the first breast shelf; and a second recess in the base located between the front safety ridge and the second breast shelf and extending from the fourth periphery toward the back wall, the second recess having a depth lower than the planar second breast shelf, and the second recess adapted for accommodating in the second recess a second shoulder and a second upper arm of the infant when the infant's head is placed on the second breast shelf.

4. The contoured infant nursing pad of claim 3 wherein:

the first recess comprises a first trough in the base located between the front safety ridge and the first breast shelf and extending from the fourth periphery towards the back wall;

wherein the depth of the first trough is lower than the planar first breast shelf; and wherein the first trough is aligned essentially perpendicular to the fourth periphery and the back wall; and the second recess comprises a second trough in the base located between the front safety ridge and the second breast shelf and extending from the fourth periphery towards the back wall;

wherein the depth of the second trough is lower than the planar second breast shelf; and wherein the second trough is aligned essentially perpendicular to the fourth periphery and the back wall.

5. The contoured infant nursing pad of claim 1 wherein the base is rectangular and has a flat bottom.

6. The contoured infant nursing pad of claim 1 wherein:

the first side wall is coupled to the back wall; and the second side wall is coupled to the back wall.

7. The contoured infant nursing pad of claim 1 wherein:

the back wall has a tapered width so that the back wall width is narrower near the first side wall and near the second side wall and greater near a center of the back wall;

wherein the tapered width provides more space for the infant's head where the back wall is narrower; and wherein the tapered width provides support for the infant's back near the center of the back wall.

8. The contoured infant nursing pad of claim 1 wherein:

the first side wall is tapered from a top of the first side wall near the fourth periphery to where the first side wall meets the base to allow eye contact between the nursing person and the infant; and the second side wall is tapered from a top of the second side wall near the fourth periphery to where the second side wall meets the base to allow eye contact between the nursing person and the infant.

9. The contoured infant nursing pad of claim 1 wherein:

the base, back wall, first side wall, second side wall, and front safety ridge are integral and comprise flexible elastic material.

10. The contoured infant nursing pad of claim 9 wherein the flexible elastic material comprises polyurethane foam.

11. The contoured infant nursing pad of claim 1 further comprising:

a cover over the contoured infant nursing pad for providing comfort and facilitating cleaning; and a plurality of pockets on the cover for holding items within easy reach of the nursing person using the contoured infant nursing pad.

12. The contoured infant nursing pad of claim 11 wherein the pockets on the cover are located adjacent to the back wall for holding items within easy reach of the nursing person using the contoured infant nursing pad.

13. A contoured infant nursing pad for use in nursing an infant, the contoured infant nursing pad comprising:

a base having a first periphery, a second periphery, a third periphery, and a fourth periphery;

a back wall coupled to the base for retaining an infant on the base;

a first side wall coupled to the base adjacent the second periphery for retaining the infant on the base;

a second side wall coupled to the base adjacent the third periphery for retaining the infant on the base;

a front safety ridge coupled to the base for retaining the infant in an optimal nursing position and for preventing a nursing person from rolling onto the infant;

wherein the front safety ridge and the back wall are coupled to the base for retaining the infant reclined between the front safety ridge and the back wall;

a first breast shelf located on the base on a first side of the front safety ridge;

wherein the first breast shelf is planar;

and wherein the planar first breast shelf extends and is inclined downward toward the back wall for aligning the infant's mouth for breastfeeding;

a second breast shelf located on the base on a second side of the front safety ridge;

wherein the second breast shelf is planar;

and wherein the planar second breast shelf extends and is inclined downward toward the back wall for aligning the infant's mouth for breastfeeding;

a first trough in the base located between the front safety ridge and the planar first breast shelf and extending from the fourth periphery towards the back wall;

wherein the depth of the first trough is lower than the planar first breast shelf; and wherein the first trough is aligned essentially perpendicular to the fourth periphery and the back wall; and a second trough in the base located between the front safety ridge and the planar second breast shelf and extending from the fourth periphery towards the back wall;

wherein the depth of the second trough is lower than the planar second breast shelf; and wherein the second trough is aligned essentially perpendicular to the fourth periphery and the back wall;

wherein the infant placed on the base between the back wall and the front safety ridge with the infant's head placed on the first breast shelf can access a breast of the nursing person placed on the first breast shelf; and wherein the infant placed on the base between the back wall and the front safety ridge with the infant's head placed on the second breast shelf can access the breast of the nursing person placed on the second breast shelf.

14. The contoured infant nursing pad of claim 13 wherein:

the planar first breast shelf extends and is further inclined downward toward the first side wall for aligning the infant's mouth for breastfeeding; and the planar second breast shelf extends and is further inclined downward toward the second side wall for aligning the infant's mouth for breastfeeding.

15. The contoured infant nursing pad of claim 13 wherein:

the back wall has a tapered width so that the back wall width is narrower near the first side wall and near the second side wall and greater near a center of the back wall;

wherein the tapered width provides more space for the infant's head where the back wall is narrower; and wherein the tapered width provides support for the infant's back near the center of the back wall.

16. The contoured infant nursing pad of claim 13 wherein:

the first side wall is tapered from a top of the first side wall near the fourth periphery to where the first side wall meets the base to allow eye contact between the nursing person and the infant; and the second side wall is tapered from a top of the second side wall near the fourth periphery to where the second side wall meets the base to allow eye contact between the nursing person and the infant.

17. The contoured infant nursing pad of claim 13 further comprising:

a cover over the contoured infant nursing pad for providing comfort and facilitating cleaning; and a plurality of pockets on the cover for holding items within easy reach of the nursing person using the contoured infant nursing pad.

18. The contoured infant nursing pad of claim 17 wherein the pockets on the cover are located adjacent to the back wall for holding items within easy reach of the nursing person using the contoured infant nursing pad.

* * * * *